US011796963B2

(12) United States Patent
Hoti et al.

(10) Patent No.: US 11,796,963 B2
(45) Date of Patent: Oct. 24, 2023

(54) EXTERNAL CONTROL MECHANISM FOR A TIMEPIECE

(71) Applicant: MECO SA, Grenchen (CH)

(72) Inventors: Valon Hoti, Bienne (CH); Rémy Thiry, Les Bréseux (FR); Samuel Geiser, Bienne (CH)

(73) Assignee: MECO SA, Grenchen (CH)

( * ) Notice: Subject to any disclaimer, the term of this patent is extended or adjusted under 35 U.S.C. 154(b) by 170 days.

(21) Appl. No.: 17/545,455

(22) Filed: Dec. 8, 2021

(65) Prior Publication Data

US 2022/0334537 A1 Oct. 20, 2022

(30) Foreign Application Priority Data

Apr. 20, 2021 (EP) ..... 21169502

(51) Int. Cl.

| | |
|---|---|
| ***G04B 27/02*** | (2006.01) |
| *G04B 19/24* | (2006.01) |
| *G04B 37/10* | (2006.01) |

(52) U.S. Cl.

CPC ..... *G04B 27/023* (2013.01); *G04B 19/24* (2013.01); *G04B 37/103* (2013.01)

(58) Field of Classification Search

None

See application file for complete search history.

(56) References Cited

U.S. PATENT DOCUMENTS

2007/0076532 A1* 4/2007 Hiranuma ..... G04B 37/10 368/319

FOREIGN PATENT DOCUMENTS

| | | | |
|---|---|---|---|
| CH | 706 221 A2 | 9/2013 | |
| CH | 706221 A2 * | 9/2013 | ..... G04B 19/223 |
| WO | 2011/104480 A1 | 9/2011 | |

OTHER PUBLICATIONS

Translation of CH706221 Abstract, Espacenet, 2023.*
Definition of ratchet, Illustrated Professional Dictionary of Horology, Berner, 2023.*
European Search Report of EP 21 16 9502 dated Sep. 15, 2021.

* cited by examiner

*Primary Examiner* — Edwin A. Leon
(74) *Attorney, Agent, or Firm* — Sughrue Mion, PLLC

(57) ABSTRACT

An external watch control device (100) including a crown (1) carrying a first barrel (2) screwed onto a tube (4), coaxially guiding a second barrel (3) includes a driver (7), the first barrel (2) and the second barrel (3) including opposing unidirectional toothing (8; 9), the tube (4) containing a spring (11) tending to move the first barrel (2) away from the driver (7), the unidirectional toothing (8; 9) are at maximum distance when the crown (1) is completely screwed onto the tube (4), and in meshing position when the crown (1) is completely unscrewed, the cooperation between the unidirectional toothing (8; 9) allowing the rotation of the first barrel (3) in a first single direction of rotation of the crown (1), and preventing it in the opposite direction against the spring (11) in the manner of a pawl.

12 Claims, 5 Drawing Sheets

Fig. 10
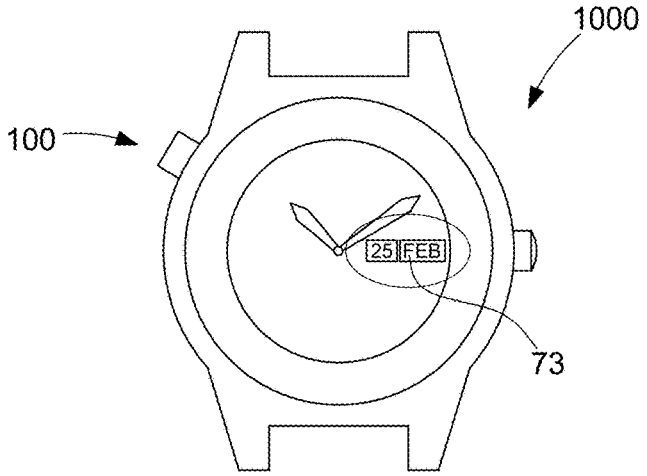
Fig. 11
29 FEB
Fig. 12
30 FEB
Fig. 13
31 FEB
Fig. 14
01 MAR
Fig. 15
30 MAR
Fig. 16
31 MAR
Fig. 17
01 APR
Fig. 18
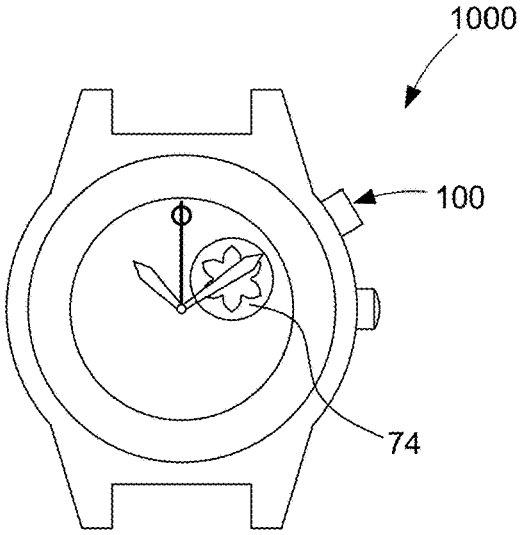

EXTERNAL CONTROL MECHANISM FOR A TIMEPIECE

CROSS REFERENCE TO RELATED APPLICATIONS

This application claims priority to European Patent Application No. 21169502.8, filed on Apr. 20, 2021, the entire contents of which are incorporated herein by reference.

TECHNICAL FIELD OF THE INVENTION

The invention relates to an external control device for a timepiece, this device includes a crown, which is arranged to be operated by a user, to control, through a driver, a rotation of a component internal to the timepiece.

The invention also relates to a timepiece including at least one such external control device.

The invention relates to the field of control mechanisms for timepieces, and more particularly for watches.

Technological Background

User control of a timepiece, in particular a watch, can be inconvenient when this timepiece has various functions and complications; the pulling of a control rod is sometimes difficult, and this component is fragile. Ancillary controls are often carried out with crowns, push-pieces, bolts, or even internal push-pieces that must be actuated with a sharp tool. These control devices must imperatively ensure the water resistance of the timepiece. In addition, in some cases it is important to be able to perform the operation in only one direction, in particular in the case of diving watches, to ensure the necessary safety.

SUMMARY OF THE INVENTION

The invention proposes to provide an external control mechanism for a timepiece, capable of controlling the rotation in one direction of a component internal to the timepiece.

To this end, the invention relates to an external control device for a timepiece, according to claim 1.

The invention also relates to a timepiece including at least one such external control device.

BRIEF DESCRIPTION OF THE FIGURES

The purposes, advantages and features of the invention will be better understood with reference to the figures illustrating a non-limiting embodiment of the invention and where:

FIGS. 7 to 18 schematically show different application possibilities of the device according to the invention to a watch shown in front view:

FIG. 7: control of a flange;

FIG. 8: control of an alarm position;

FIG. 9: control of a time zone for a universal watch;

FIGS. 10 to 17 displays of a date and the current month;

FIG. 18: control of a chronograph.

DETAILED DESCRIPTION OF THE INVENTION

The invention proposes to provide an external control mechanism for a timepiece, capable of controlling the rotation in one direction only of a component internal to the timepiece.

The invention relates to an external control device 100 for a timepiece 1000. This device 100 includes a crown 1, which is arranged to be operated by a user, to control, through a driver 7, a rotation of a component 70, 71, 72, 73, 74, internal to the timepiece 1000.

Figure 1:
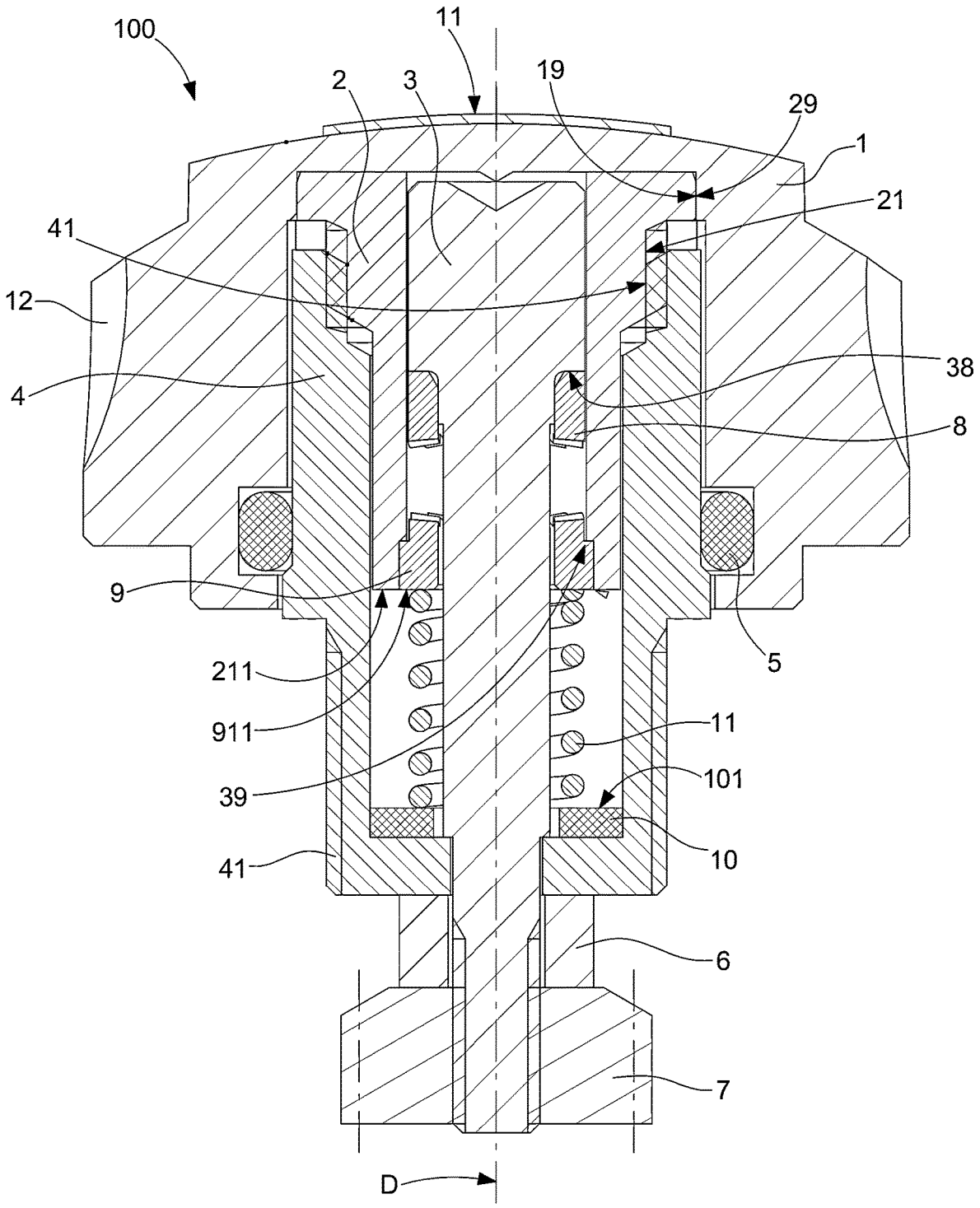
FIG. 1 shows, schematically and in section passing through an axis around which are coaxially mounted its various components, and in an intermediate screwing position, an external control device according to the invention, which includes from the top (outside) towards the bottom (inside) of the figure and from the periphery towards the axis, a crown that can be operated axially and in rotation by the user, a tube intended to be inserted and screwed into a timepiece, a first barrel secured to the crown and cooperating by screwing with the tube, and carrying, at its lower part, a unidirectional toothing facing outward; this first barrel contains a second barrel carrying a driver and includes unidirectional toothing opposing the previous one and facing inward; the first barrel is pushed outwards by a spring bearing on a front wall of the tube; the driver ensures the axial retention of the second barrel in the tube.

The device 100 includes a tube 4, which is arranged to pass through an outer wall of the timepiece 1000, and to be fastened thereto while ensuring the water-resistant retention of the external control device 100. The crown 1 carries a first barrel 2, which is screwed onto the tube 4, by cooperation of a tapping 41 of the tube 4 with a thread 21 of the first barrel 2. In a variant, the crown 1 is integral with the first barrel 2. The first barrel 2 and/or the tube 4 ensures the guidance, along an axis D, of a second barrel 3 which is coaxial with the first barrel 2 and which is movable only in rotation about the axis D. This second barrel 3 includes the driver 7, at a distal end which is arranged to be inserted into the timepiece 1000. More particularly, the second barrel 3 includes a shoulder bearing on an internal surface of a front wall of the tube 4, as can be seen in FIG. 1, and it is retained axially, on the other side of this front wall of the tube 4, by a friction ring 6 which is held clamped by the driver 7 which is screwed onto the second barrel 3, this configuration not being in any way limiting. The first barrel 2 is movable axially in the direction of the axis D and in rotation around the axis D. The crown 1 and the tube 4 together define at least one chamber containing at least one seal 5, of the O-ring type or the like.

According to the invention, the first barrel 2 includes a first unidirectional toothing 9, and the second barrel 3 includes a second unidirectional toothing 8 which is coaxial and opposing the first unidirectional toothing 9. And the tube 4 contains at least one elastic return means 11 bearing below a lower front surface 101 of the tube 4 or of a bearing element 10 attached to the tube 4; this at least one elastic return means 11 tends to move the first barrel 2 away from the driver 7, by bearing above an upper front surface 211, 911, included in the first barrel 2 or respectively the first unidirectional toothing 9. The optional bearing element 10 is advantageously produced in the shape of a ring made of a material with a low coefficient of friction, such as "teflon" or the like.

Figure 2:
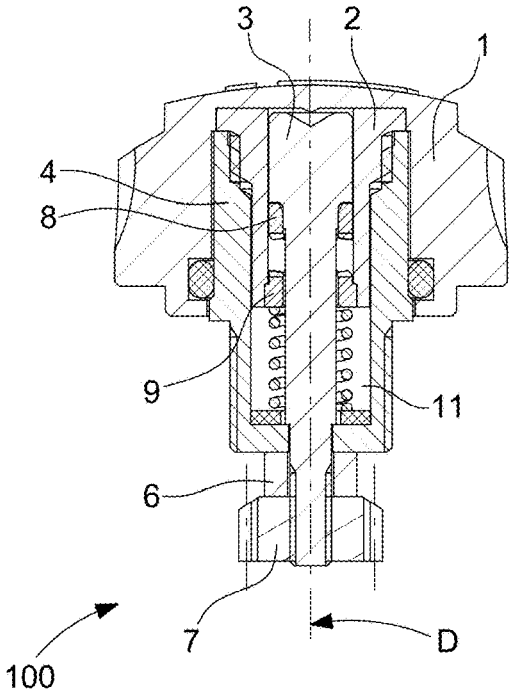
FIG. 2 shows, similarly to FIG. 1, the same device in a position where the crown is completely screwed onto the tube, where the toothing are at maximum distance from each other, and where any operation of the driver by the crown is impossible.
Figure 3:
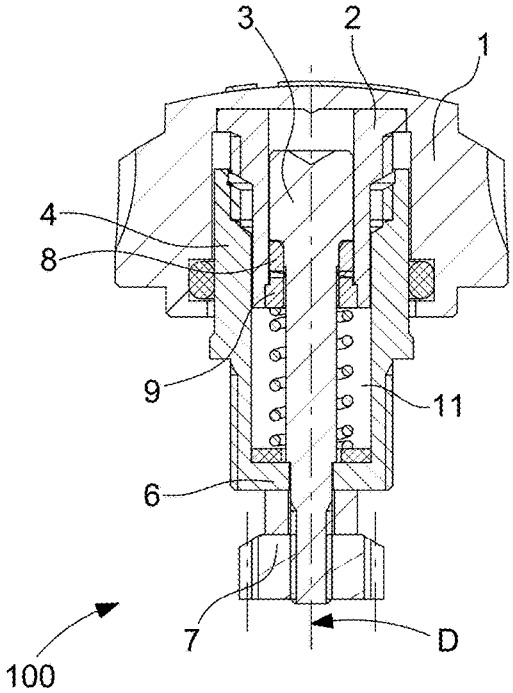
FIG. 3 shows, similarly to FIG. 1, the same device in a position where the crown is completely unscrewed relative to the tube, where the toothing are meshed, and where an operation of the driver by the crown is possible.
Figure 4:
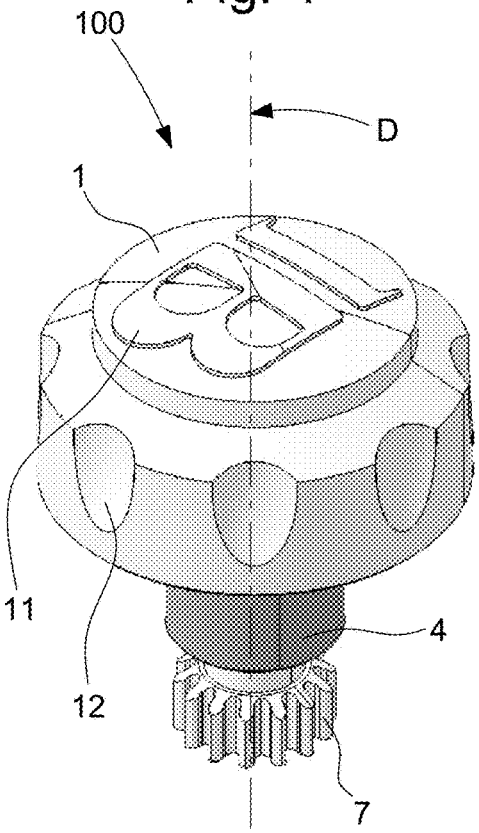
FIG. 4 shows, schematically and in perspective, the same device as seen by the user, and which constitutes a removable sub-assembly ready to be inserted into a timepiece.
Figure 5:
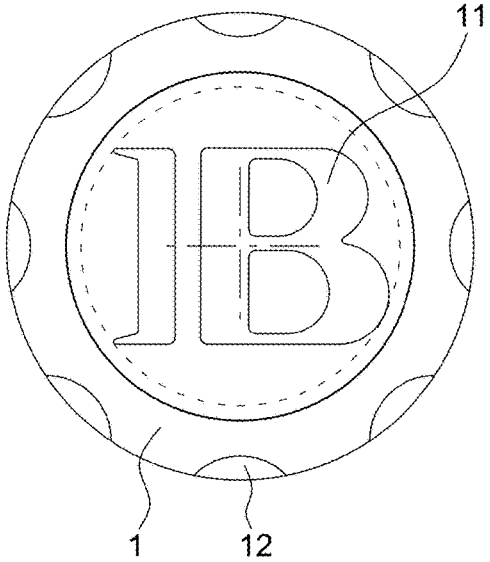
FIG. 5 shows, schematically and in end view, the crown of the same device as seen by the user.
Figure 6:
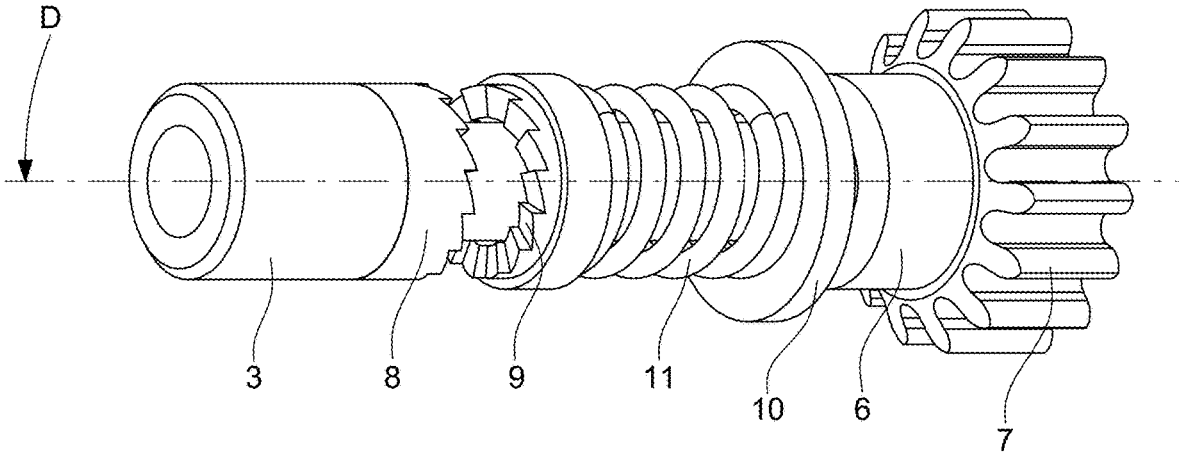
FIG. 6 shows, schematically and in perspective, an axial part of the same device, in transparency of the tube not shown, the first barrel and the crown not being shown and only the toothing integral with the first barrel being here shown before being secured to the first barrel.
Figure 7:
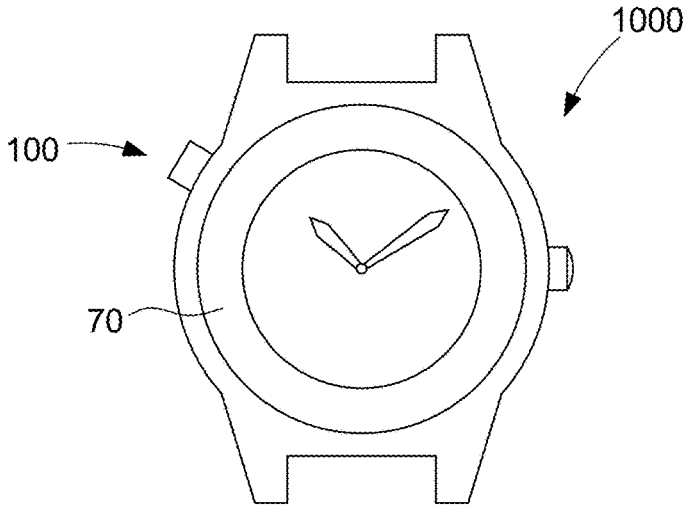
Figure 8:
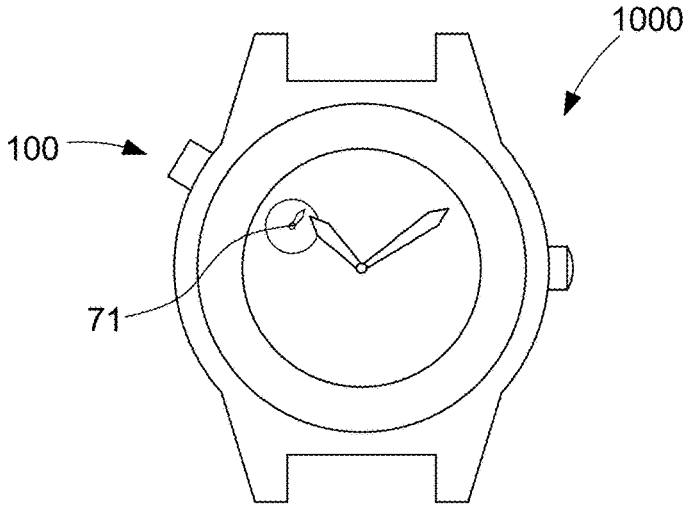
Figure 9:
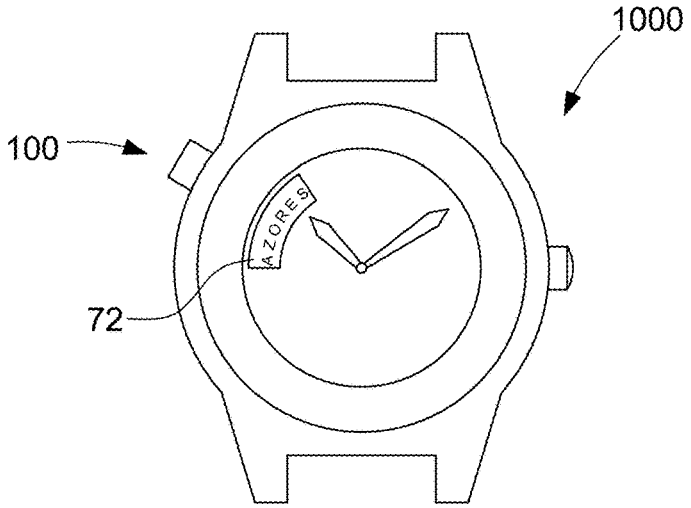

FIG. 2 illustrates the position of maximum separation between the first unidirectional toothing 9 and the second unidirectional toothing 8, when the crown 1 is completely screwed onto the tube 4, and is as close as possible to the driver 7. When unscrewing the crown 1, the first unidirectional toothing 9 and the second unidirectional toothing 8 move closer to each other and reach a position of meshing with each other a little before stopping the cooperation between the tapping 41 of the tube 4 and the thread 21 of the first barrel 2. FIG. 3 illustrates the extreme position, where the crown is only kinematically connected to the second barrel 3 by the meshing between the first unidirectional toothing 9 and the second unidirectional toothing 8, and the crown 1, completely unscrewed, is then farthest from the driver 7.

The cooperation between the first unidirectional toothing 9 and the second unidirectional toothing 8 allows rotating the second barrel 3 in a first single direction of rotation of the crown 1, and prevents the rotation of the second barrel 3 in a second direction opposite to the first direction by jumping against the elastic return means 11 in the manner of a pawl. The screwing stroke of the crown 1 on the tube 4 is slightly greater than the difference between the extreme positions of the first unidirectional toothing 9 and the second unidirectional toothing 8: it is understood that after a complete unscrewing of the crown 1, in the position visible in FIG. 3, the first unidirectional toothing 9 and the second unidirectional toothing 8 are then engaged with each other under the pushing of at least one elastic return means 11, illustrated without limitation in the shape of a helical spring, and the continuation of a rotation imparted to the crown 1 in the first direction controls the rotation of the second barrel 3. In this same completely unscrewed position, a rotation of the crown 1 does not allow to drive the second barrel 3. After the execution of the desired manipulation by the driver 7, an axial pushing of the user on the crown 1 towards the outer wall of the timepiece 1000 allows the first unidirectional toothing 9 to be disengaged from the second unidirectional toothing 8, and to cooperate the tapping 41 and the thread 21, in order to screw the crown back. Thus safety is perfect as regards the driver 7, which cannot be rotated by any accidental operation.

More particularly, the first unidirectional toothing 9 and the second unidirectional toothing 8 constitute the only engagement means between the crown 1 and the driver 7. This allows both to limit the size and the production cost.

More particularly, the first unidirectional toothing 9 is irremovably secured to the first barrel 2, or/and the second unidirectional toothing 8 is irremovably secured to the second barrel 3. Such an irremovable connection can be produced by welding, gluing, or any other method for making the connection irreversible. It is also possible to irremovably secure the crown 1 in a similar manner to the first tube 2. In the particular non-limiting case of the figures, these three irremovable connections are of the driven-welded type. The welding of the first unidirectional toothing 9 on the first barrel 2 has the effect of immovably enclosing the second unidirectional toothing 8 previously secured to the second barrel 3.

More particularly, the first unidirectional toothing 9 and the second unidirectional toothing 8 are Breguet toothing, or ratchet toothing, which are facing each other.

More particularly, the driver 7 includes at least one toothing or at least one flute for driving a component 70, 71, 72, 73, 74, internal to the timepiece 1000. The figures illustrate a variant where the driver 7 is a pinion.

In the particular non-limiting variant illustrated by the figures, the crown 1 includes a marking 11, in particular a raised marking, which is oriented in a particular angular position in the completely screwed position of the crown 1 on the tube 4.

In one variant, the component internal to the timepiece 1000 is a display component 70, 71, 72, 73, or an intermediate component which is arranged to control a movement of a display component 70, 71, 72, 73

In another variant, the component internal to the timepiece 1000 is an internal control component 74 or an intermediate component arranged to control a movement of an internal control component 74 to initiate or stop a function or perform a reset or an incremental jump.

More particularly, the external control device 100 is separate from any control rod included in the timepiece 1000.

More particularly, the external control device 100 constitutes a removable and fool-proof sub-assembly, which constitutes a single assembly component, very easy to be integrated. In particular, the execution with irremovable connections between the unidirectional toothing and their respective tubes is particularly advantageous in this regard.

The invention also relates to a timepiece 1000 including at least one such external control device 100.

In a particular embodiment, the timepiece 1000 includes a flange 70 which is arranged to be driven by the driver 7, and/or an alarm hour indicator 71 arranged to be driven by the driver 7, and/or a time zone display 72 arranged to be driven by the driver 7, and/or a similar display.

In another particular embodiment, the timepiece 1000 includes a calendar mechanism including at least one display 73 arranged to be driven by the driver 7. FIGS. 10 to 17 illustrate the example of the application to a simple date mechanism, for which the user must himself ensure the end-of-month or leap-year corrections: the use of an external control device 100 according to the invention allows to avoid the usual operations and inconvenient adjustment by pressing a point on an internal push-piece, or else the tedious operations through the control rod, and the user can, very easily and in complete safety, control the passage from 28 February to 29 February for a leap year, or to 1 March in the case of a normal year, by successive controls of one tooth each time; changing the name of the month can be executed in the same way.

In yet another particular embodiment, the timepiece 1000 includes a chronograph mechanism with a trigger 74 arranged to be driven by the driver 7.

In short, the crown 1 of the external control device 100 according to the invention can be screwed or unscrewed: when it is unscrewed, an engagement is performed by means of Breguet toothing or the like. This toothing allows to drive the second barrel 3 carrying the driver 7 in a single direction of rotation, and thus to rotate a component internal to the timepiece, in particular a watch, such as a flange; if the user moves the crown & in the other direction, the toothing jumps, like the sliding pinions in conventional mechanical horological movements.

More particularly, the timepiece 1000 is a watch.

Many other applications of the invention are possible, due to its simplicity, its controlled cost, and ease of assembly since it suffices to insert a one-piece sub-assembly in a housing of a wall of a timepiece.

The invention claimed is:

1. An external control device (100) for a timepiece (1000), including a crown (1) arranged to be operated by a user, to control, through a driver (7), a rotation of a component (70, 71, 72, 73, 74) internal to said timepiece (1000), said device (100) including a tube (4) arranged to pass through an outer wall of said timepiece (1000) and to be fastened thereto while ensuring the water-resistant retention of said external control device (100), said crown (1) carrying a first barrel (2) screwed onto said tube (4), and said first barrel (2) and/or said tube (4) guiding, along an axis (D), a second barrel (3) which is coaxial with said first barrel (2) and which is movable only in rotation about said axis (D) and which includes said driver (7) at a distal end arranged to be inserted into said timepiece (1000), said first barrel (2) being movable axially in the direction of said axis (D) and in rotation around said axis (D), wherein:

said first barrel (2) includes a first unidirectional toothing (9), said second barrel (3) includes a second unidirectional toothing (8) coaxial and opposing said first unidirectional toothing (9), said tube (4) contains at least one elastic return means (11) bearing on a lower front surface (101) of said tube (4) or of a bearing element (10) attached to said tube (4), said at least one elastic return means (11) tending to move said first barrel (2) away from said driver (7) by bearing on an upper front surface (211, 911) included in said first barrel (2) or said first unidirectional toothing (9), said first unidirectional toothing (9) and said second unidirectional toothing (8) are in the position of maximum separation from one another when said crown (1) is completely screwed onto said tube (4) as close as possible to said driver (7), and are in a position of meshing with each other when said crown (1) is completely unscrewed and is farthest from said driver (7), the cooperation between said first unidirectional toothing (9) and said second unidirectional toothing (8) allowing to rotate said second barrel (3) in a first single direction of rotation of said crown (1), and preventing the rotation of said second barrel (3) in a second direction opposite to said first direction by jumping against said elastic return means (11) in the manner of a pawl.

2. The external control device (100) according to claim 1, wherein said first unidirectional toothing (9) and said second unidirectional toothing (8) constitute the only engagement means between said crown (1) and said driver (7).

3. The external control device (100) according to claim 1, wherein said first unidirectional toothing (9) is irremovably secured to said first barrel (2) and wherein said second unidirectional toothing (8) is irremovably secured to said second barrel (3).

4. The external control device (100) according to claim 1, wherein said first unidirectional toothing (9) and said second unidirectional toothing (8) are Breguet or ratchet toothing, which are facing each other.

5. The external control device (100) according to claim 1, wherein said driver (7) includes at least one toothing or at least one flute for driving said component (70, 71, 72, 73, 74) internal to said timepiece (1000).

6. The external control device (100) according to claim 1, wherein said component internal to said timepiece (1000) is a display component (70, 71, 72, 73) or an intermediate component arranged to control a movement of a display component (70, 71, 72, 73).

7. The external control device (100) according to claim 1, wherein said component internal to said timepiece (1000) is an internal control component (74) or an intermediate component arranged to control a movement of an internal control component (74) to initiate or stop a function or perform a reset or an incremental jump.

8. The external control device (100) according to claim 1, wherein said external control device (100) is separate from any control rod included in said timepiece (1000).

9. The external control device (100) according to claim 1, wherein said external control device (100) constitutes a removable sub-assembly.

10. A timepiece (1000) including at least one external control device (100) including a crown (1) arranged to be operated by a user, to control, through a driver (7), a rotation of a component (70, 71, 72, 73, 74) internal to said timepiece (1000), said device (100) including a tube (4) arranged to pass through an outer wall of said timepiece (1000) and to be fastened thereto while ensuring the water-resistant retention of said external control device (100), said crown (1) carrying a first barrel (2) screwed onto said tube (4), and said first barrel (2) and/or said tube (4) guiding, along an axis (D), a second barrel (3) which is coaxial with said first barrel (2) and which is movable only in rotation about said axis (D) and which includes said driver (7) at a distal end arranged to be inserted into said timepiece (1000), said first barrel (2) being movable axially in the direction of said axis (D) and in rotation around said axis (D), wherein:

said first barrel (2) includes a first unidirectional toothing (9), said second barrel (3) includes a second unidirectional toothing (8) coaxial and opposing said first unidirectional toothing (9), said tube (4) contains at least one elastic return means (11) bearing on a lower front surface (101) of said tube (4) or of a bearing element (10) attached to said tube (4), said at least one elastic return means (11) tending to move said first barrel (2) away from said driver (7) by bearing on an upper front surface (211, 911) included in said first barrel (2) or said first unidirectional toothing (9), said first unidirectional toothing (9) and said second unidirectional toothing (8) are in the position of maximum separation from one another when said crown (1) is completely screwed onto said tube (4) as close as possible to said driver (7), and are in a position of meshing with each other when said crown (1) is completely unscrewed and is farthest from said driver (7), the cooperation between said first unidirectional toothing (9) and said second unidirectional toothing (8) allowing to rotate said first barrel (3) in a first single direction of rotation of said crown (1), and preventing the rotation of said first barrel (3) in a second direction opposite to said first direction by jumping against said elastic return means (11) in the manner of a pawl, wherein said component internal to said timepiece (1000) is a display component (70, 71, 72, 73) or an intermediate component arranged to control a movement of a display component (70, 71, 72, 73) and said timepiece (1000) includes a flange (70) arranged to be driven by said driver (7), and/or an alarm hour indicator (71) arranged to be driven by said driver (7), and/or a time zone display (72) arranged to be driven by said driver (7).

11. A timepiece (1000) including at least one external control device (100) including a crown (1) arranged to be operated by a user, to control, through a driver (7), a rotation of a component (70, 71, 72, 73, 74) internal to said timepiece (1000), said device (100) including a tube (4) arranged to pass through an outer wall of said timepiece (1000) and to be fastened thereto while ensuring the water-resistant retention of said external control device (100), said crown (1) carrying a first barrel (2) screwed onto said tube (4), and said first barrel (2) and/or said tube (4) guiding, along an axis (D), a second barrel (3) which is coaxial with said first barrel (2) and which is movable only in rotation about said axis (D) and which includes said driver (7) at a distal end arranged to be inserted into said timepiece (1000), said first barrel (2) being movable axially in the direction of said axis (D) and in rotation around said axis (D), wherein:

said first barrel (2) includes a first unidirectional toothing (9), said second barrel (3) includes a second unidirectional toothing (8) coaxial and opposing said first unidirectional toothing (9), said tube (4) contains at least one elastic return means (11) bearing on a lower front surface (101) of said tube (4) or of a bearing element (10) attached to said tube (4), said at least one elastic return means (11) tending to move said first barrel (2) away from said driver (7) by bearing on an upper front surface (211, 911) included in said first barrel (2) or said first unidirectional toothing (9), said first unidirectional toothing (9) and said second unidirectional toothing (8) are in the position of maximum separation from one another when said crown (1) is completely screwed onto said tube (4) as close as possible to said driver (7), and are in a position of meshing with each other when said crown (1) is completely unscrewed and is farthest from said driver (7), the cooperation between said first unidirectional toothing (9) and said second unidirectional toothing (8) allowing to rotate said first barrel (3) in a first single direction of rotation of said crown (1), and preventing the rotation of said first barrel (3) in a second direction opposite to said first direction by jumping against said elastic return means (11) in the manner of a pawl, wherein said component internal to said timepiece (1000) is a display component (70, 71, 72, 73) or an intermediate component arranged to control a movement of a display component (70, 71, 72, 73) and said timepiece (1000) includes a calendar mechanism including at least one display (73) arranged to be driven by said driver (7).

12. A timepiece (1000) including at least one external control device (100) including a crown (1) arranged to be operated by a user, to control, through a driver (7), a rotation of a component (70, 71, 72, 73, 74) internal to said timepiece (1000), said device (100) including a tube (4) arranged to pass through an outer wall of said timepiece (1000) and to be fastened thereto while ensuring the water-resistant retention of said external control device (100), said crown (1) carrying a first barrel (2) screwed onto said tube (4), and said first barrel (2) and/or said tube (4) guiding, along an axis (D), a second barrel (3) which is coaxial with said first barrel (2) and which is movable only in rotation about said axis (D) and which includes said driver (7) at a distal end arranged to be inserted into said timepiece (1000), said first barrel (2) being movable axially in the direction of said axis (D) and in rotation around said axis (D), wherein:

said first barrel (2) includes a first unidirectional toothing (9), said second barrel (3) includes a second unidirectional toothing (8) coaxial and opposing said first unidirectional toothing (9), said tube (4) contains at least one elastic return means (11) bearing on a lower front surface (101) of said tube (4) or of a bearing element (10) attached to said tube (4), said at least one elastic return means (11) tending to move said first barrel (2) away from said driver (7) by bearing on an upper front surface (211, 911) included in said first barrel (2) or said first unidirectional toothing (9), said first unidirectional toothing (9) and said second unidirectional toothing (8) are in the position of maximum separation from one another when said crown (1) is completely screwed onto said tube (4) as close as possible to said driver (7), and are in a position of meshing with each other when said crown (1) is completely unscrewed and is farthest from said driver (7), the cooperation between said first unidirectional toothing (9) and said second unidirectional toothing (8) allowing to rotate said first barrel (3) in a first single direction of rotation of said crown (1), and preventing the rotation of said first barrel (3) in a second direction opposite to said first direction by jumping against said elastic return means (11) in the manner of a pawl, said component internal to said timepiece (1000) is an internal control component (74) or an intermediate component arranged to control a movement of an internal control component (74) to initiate or stop a function or perform a reset or an incremental jump, and said timepiece (1000) includes a chronograph mechanism with a trigger (74) arranged to be driven by said driver (7).

* * * * *